United States Patent [19]

Busch, deceased et al.

[11] 4,152,557

[45] May 1, 1979

[54] SAFETY PLUG SOCKET

[76] Inventors: Manfred Busch, deceased, late of Hebertshausen, Fed. Rep. of Germany; by Jakob Busch, heir; by Therese Busch nee Schmid, heir, both of Buergermeister Herzog Str. 1, D-8061 Herbertshausen, Fed. Rep. of Germany

[21] Appl. No.: 837,207

[22] Filed: Sep. 27, 1977

[30] Foreign Application Priority Data

Sep. 28, 1976 [DE] Fed. Rep. of Germany ..... 2643668

[51] Int. Cl.[2] ..... H01R 13/70

[52] U.S. Cl. ..... 200/51.09

[58] Field of Search ..... 200/51.09

[56] References Cited

U.S. PATENT DOCUMENTS

| | | | |
|---|---|---|---|
| 3,598,941 | 8/1971 | Nelson | 200/51.09 |
| 3,801,757 | 4/1974 | Carissimi | 200/51.09 X |

FOREIGN PATENT DOCUMENTS

| | | | |
|---|---|---|---|
| 2164617 | 6/1973 | Fed. Rep. of Germany | 200/51.09 |

*Primary Examiner*—Donald F. Norton

*Attorney, Agent, or Firm*—Hill, Gross, Simpson, Van Santen, Steadman, Chiara & Simpson

[57] ABSTRACT

A safety plug socket has two independently actuated circuit breakers. The two circuit breakers are in the form of a common C-shaped leaf spring and two conducting actuating pins which are movable to close the circuit breakers when a plug on a line cord from a consumer appliance is inserted into the socket of the circuit outlet to move the actuating pins of the two circuit breakers into contact with the conductive leaf spring. In one form of the invention, the biasing springs of the circuit breakers are current carrying and form a part of the supply circuit. In another form of the invention, each circuit element comprises leaf spring contact arms which are bridged by a conductive bridging member carried by respectively actuating pins of the circuit breakers. Power can only be obtained from the outlet socket when both circuit breakers are closed and when the plug from the consumer appliance has been moved into the outlet socket, which action closes off access to the tubular contacts to the circuit breakers.

5 Claims, 10 Drawing Figures

2
5
20
3
6
8
4
4
8
6
II
II
7
9
7
5
1

13
11
11
18
12
1
10
14
14
16
16
7
4
9
4
7
8
8
6
5
6
2
3

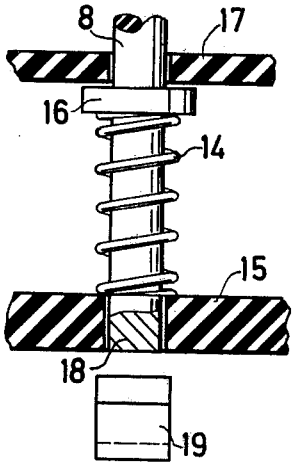
Fig. 3a
Fig. 3b
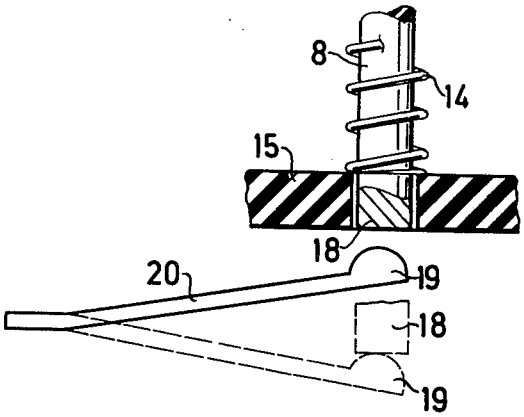
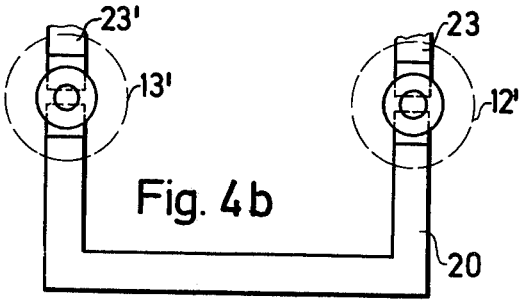
Fig. 4b
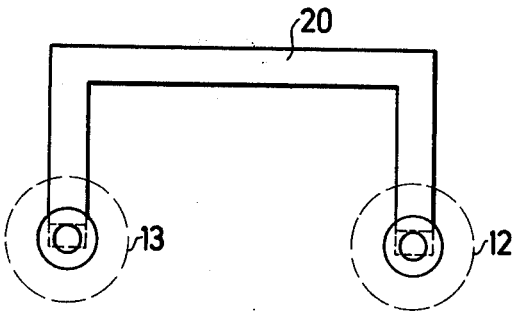
Fig. 3c
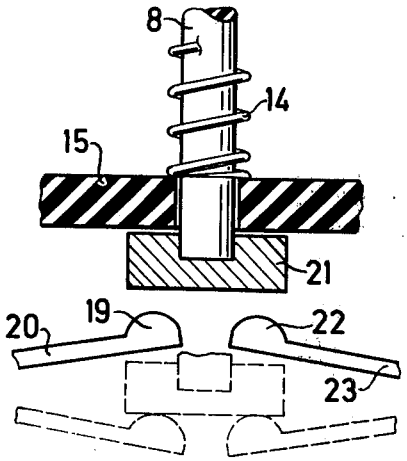
Fig. 4a Fig. 5
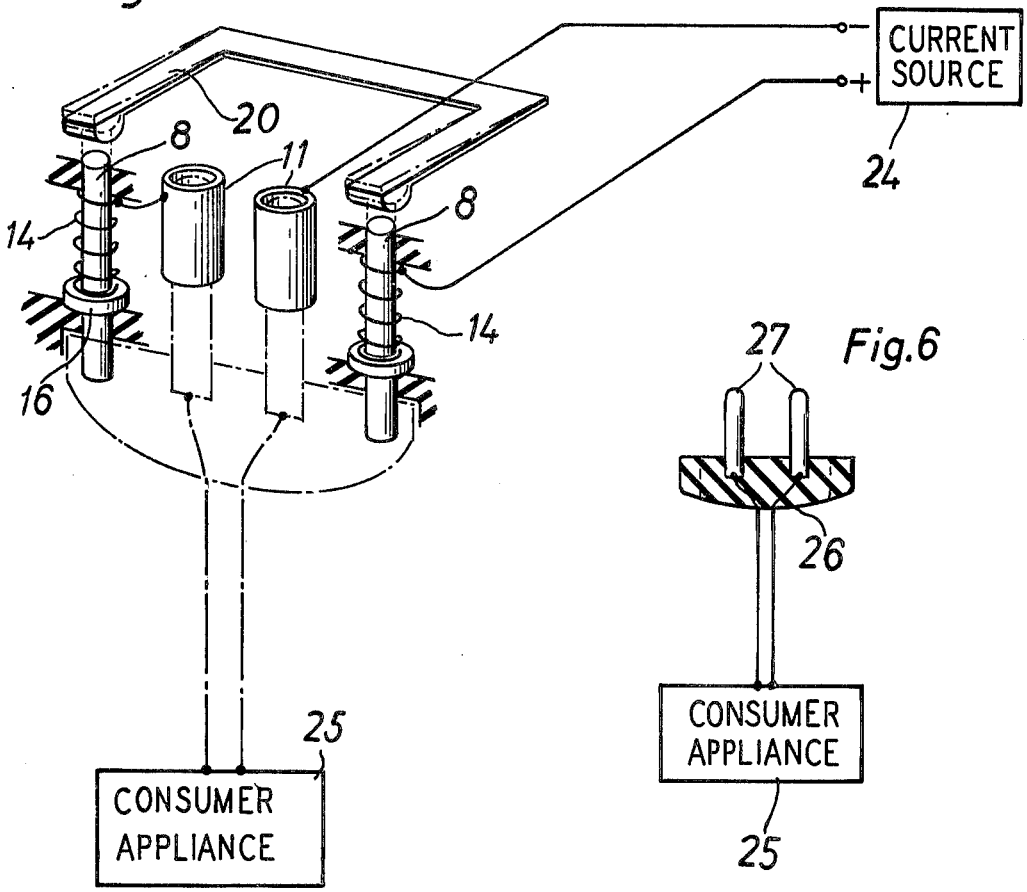
Fig. 6
Fig. 7
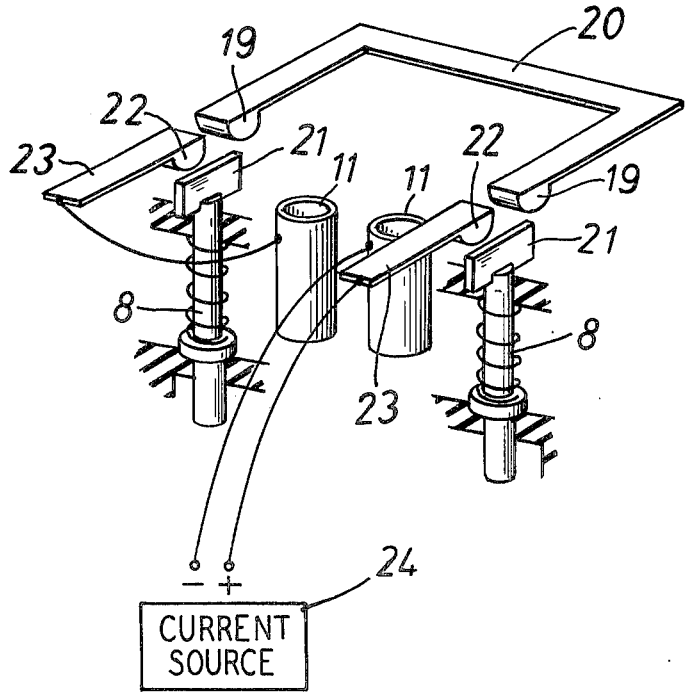

SAFETY PLUG SOCKET

INTRODUCTION

The invention concerns a safety plug socket for two-pole normal or safety plugs, with two actuating members being independent of one another projecting into the plug box.

BACKGROUND OF THE INVENTION

Such a safety plug socket is described in the DT-GM 7 007 875. In the case of this familiar safety plug socket the ends of two-armed levers project into the lateral fitting grooves of the plug box. By means of lock springs, the levers turn a shutter disc which is parallel to the floor of the plug box, when a matching plug is plugged in. In this way, the contact sockets being initially covered by the shutter disc are freed for the insertion of the current-conducting plug contacts. The springs interacting with the levers are in this case so dimensioned that the actuation of only one lever does not suffice to rotate the shutter disc into the releasing position. This shutting mechanism prevents children from sticking any objects into the contact sockets, which action could lead to an electric shock.

In this familiar arrangement one cannot exclude the danger, after a long period of use, of fouling of the arrangement, slackening of the springs or bending of parts of the two-armed levers, so that the shutter disc no longer safely closes off the contact sockets. Since there is no regular check made on plug sockets, the failure of the safety mechanism could remain unnoticed for a long time. This is however extremely dangerous, since, being confident in the supposed safety function of the plug socket, one lets children play in the proximity of the plug socket with wires or other conducting objects without intervening. A further disadvantage of the familiar arrangement lies in that when attempting to plug non-matching plugs, belonging for example to a foreign system or to shaving apparatuses, into the plug socket, considerable force is applied which can under certain circumstances damage the shutter disc and its actuation mechanism, so that the safety function is lost or that matching plugs can subsequently no longer be plugged in.

BRIEF SUMMARY OF THE INVENTION

The present invention has therefore the task of creating a safety plug of the general type described above which offers increased safety and which is not damaged by the forceful insertion of foreign bodies into the plug sockets.

In the present invention, two circuit breakers are connected in series with two contact socket sleeves, and in series with the circuit of the consumer appliance across the power source. The safety plug socket of the present invention includes a base part in which there is mounted two tubular contact sleeves and in which there is also mounted two circuit breakers which are normally biased of their open position. The circuit breakers are closed by means of axially movable pins which are engaged when the plug of the consumer appliance is pushed into the plug receptacle, this being done by causing the pins to be moved against the movable contact, respectively, of each circuit breaker to cause the same to close. No power from the power source can inadvertently reach any point in the assembly when the plug has been inserted, since the plug fills the socket before the circuit breakers are closed. This arrangement eliminates the need for a shutter plate. It further eliminates the possibility of an accidental contact with the live portion of the circuit which might otherwise be exposed in the socket.

In the case of the safety switch according to the invention the contact sockets are not closed, so that corresponding shutter elements cannot be forcibly destroyed or damaged. Insertion of foreign bodies into the contact sockets is however completely free from danger as these are without current so long as both actuating members are not simultaneously pushed in and the matching circuit breakers closed.

Each of the actuating members is preferably connected mechanically with a conducting element, being electrically insulated from this, whereby the conducting element lies opposite to at least one contact of the corresponding circuit breaker. The actuating members are preferably flexibly supported.

It is particularly favourable if the actuating members consist of pins which are held in their resting position by spiral springs surrounding them. It is practical if the pins are parallel to the contact sockets.

According to a particularly preferred version of the invention, the pins are non-conducting in the outward-projecting region. In this case one element connecting with the current-carrying pole of the current source is connected with the spiral spring surrounding the one pin and one of the contact sockets is connected with the spiral spring surrounding the other pin, whereby both spiral springs touch the corresponding conducting elements and/or are connected with these.

According to a second particularly preferred version of the invention two contacts are so positioned in relation to each conducting element that the element bridges the gap between the contacts when the actuating elements are moved; in so doing the one contact of the one circuit breaker is connected with an element connecting to the current-carrying pole and the one contact of the second circuit breaker is connected with the one contact socket, whilst the two other contacts of the two circuit breakers are directly connected with one another. This arrangement has the advantage that the current conducting components are not exposed to mechanical burdening.

It is especially favourable if each circuit breaker has at least one leaf spring as contact or contacts, with which the conducting element, being mechanically connected with the actuating member, makes contact. A leaf spring is in this case usefully supported or fixed in such a way that its two free ends each form a contact of the two circuit breakers.

BRIEF DESCRIPTION OF THE DRAWINGS

Further details annd advantages of the invention become apparent from the accompanying drawings:

FIG. 3 shows details of a first embodiment of the safety plug socket according to this invention, whereby in FIG. 3*a*, is a folded-back view of a circuit breaker as shown in FIG. 3*b*; a further lateral view turned through 90° of the same is shown in FIG. 3*c*.

FIG. 4 shows detailed views of the second embodiment of the safety plug socket according to this invention, wherein FIG. 4*a* diagrammatically illustrates in a folded-back section, a view of the circuit breaker, and FIG. 4*b* is a view of the circuit breakers and their connecting circuit.

FIG. 5 is a schematic representation of the safety plug socket in a circuit in which a consumer appliance is connected to a current source.

FIG. 6 is a schematic representation of a plug at the end of the electric cord coming from the consumer appliance.

FIG. 7 is a schematic representation of the embodiment of FIG. 4*a* and FIG. 4*b* in a circuit in which a consumer appliance is connected to a current source.

DESCRIPTION OF THE PREFERED EMBODIMENTS

Figure 1:
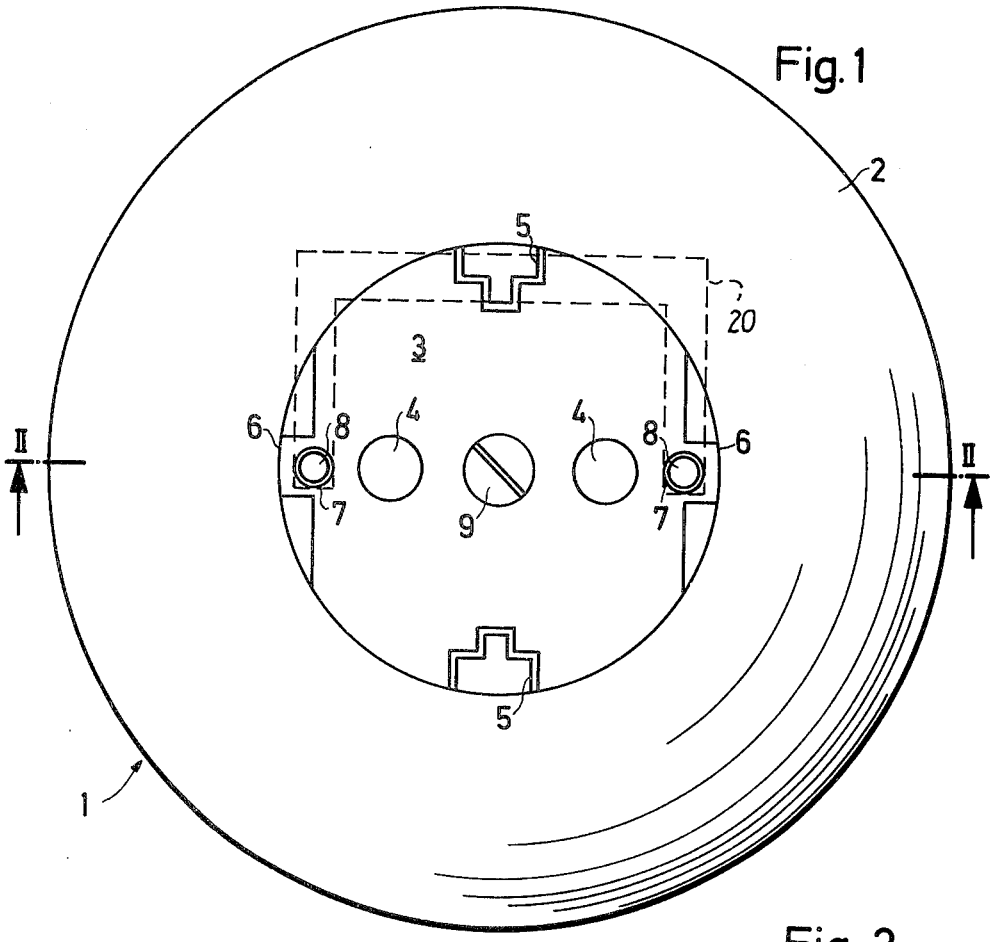
FIG. 1 shows in front view a safety plug socket according to the invention.
Figure 2:
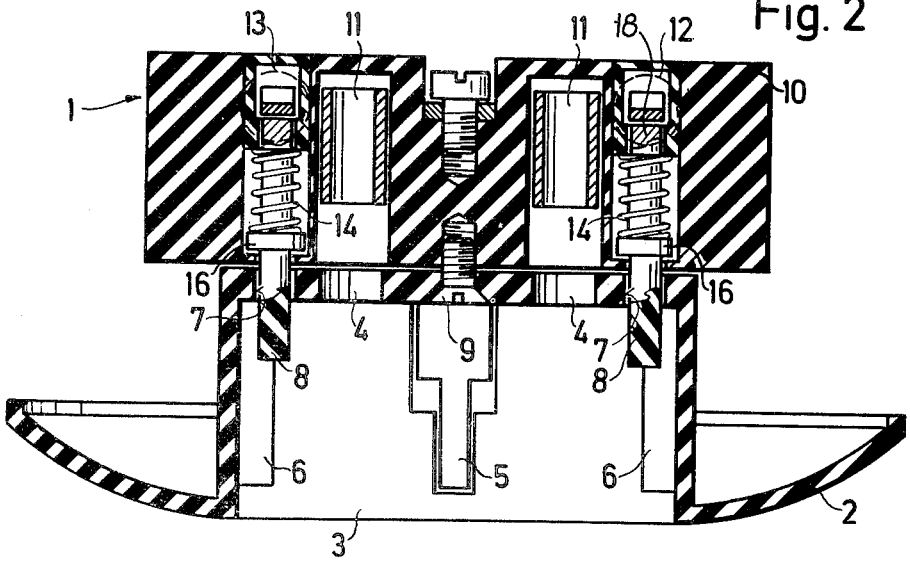
FIG. 2 shows a section along the line II-II through the safety plug socket of FIG. 1, whereby for the sake of clarity only the mechanical elements diagrammatically illustrated.

The safety plug socket shown in FIGS. 1 and 2 has a cover (2) with a plug box (3), on the inner wall of which the two plug inseration openings (4) are located. The plug box (3) has in addition two safety contacts (5) as well as two lateral fitting grooves (6), being formed by projections and in which bore cylinders (7) for the accommodation of pins (8) are provided, which project in the area of the fitting grooves loosely upwards in the plug box. The cover (2) is screwed by means of a screw (9) onto a plug base (10) which conventionally has two contact sockets (11) as well as the corresponding connections, not shown in the drawing, to the electric circuit. In the plug base (10) there are in addition two circuit breakers (12) and (13), whose movable element is formed by the lower ends of the pins (8). By means of surrounding spiral springs (14) which are supported on a part (15) of the plug base (10), the pins (8) are held upwards, i.e. in direction of the plug box (3), whereby they are supported on a collar (16) of the pins (8). The collar (16) is held in position againt an upper cover plate (17), which can be formed by the underside of the cover (2). By pushing in the pin (8) against the force of the spiral spring (14), the lower end (18) of the pin (8) projects through a hole in the part (15) and connects with a fixed contact (19) of the corresponding circuit breaker which is attached underneath. The details described are particularly clear from FIG. 3*a* and FIG. 5.

One can see from FIG. 3*b* that the contact (19) forms the one end of a leaf spring (20) which, as shown in FIG. 3*c*, connects the circuit breakers (12) and 13) when pushed in by a certain amount. The ends (18) of the pins (8) come up against the contacts (19) and guide these through further bending of the leaf spring 20 until the positions are reached as illustrated in FIG. 3*b* by the dotted line.

As shown in FIG. 2 and FIG. 5, the part (18) of each pin (8) which extends into the base (15) is formed of conducting material. The part, however, which extends into the open socket of each pin is formed of insulating material or at least has an insulating covering thereon. The spiral spring (14) which provides for biasing the circuit breakers (12) and (13) into normally open position is also made of a good conducting material. As shown in FIG. 2 and FIG. 5, the non-conducting portion of the actuating pin (8) projects out into the open socket (6') in which the plug is to be inserted. The part of each pin (8) lying above the collar (16) is, in contrast, conducting, as is the end which extends into the base (17) of the socket member (FIG. 3*a*).

Before going further with the detailed description of the physical structure, it is believed it wil be more readily understood by referring to the schematic sketch shown in FIG. 5. Here two conventional contact sockets (11) are provided to receive the male prongs (27) of the plug (26), shown as being tubular in form. The two circuit breakers are made up of the conducting portions of the pins (8) which, when moved upwardly as shown in FIG. 5, make contact with a leaf spring (20) which is in the form of a C-shaped member. It will be noted from FIG. 5 that the lower end of each pin below a collar (16) is formed of insulating material. Also, as shown in FIG. 5, the socket is arranged to be energized from a current source (24) which, as shown, has its positive terminal connected to a conductive coil spring (14). The negative terminal of the current source (24) is connected directly to the right-hand contact socket (11). The contact socket (11), as shown on the left in FIG. 5, is connected with the conductive coil spring (14) which is associated with the tubular contact socket (11). A consumer appliance (25) has a plug (26) which has protruding conductive prongs (27). When the plug is inserted into the open cover (2), the plug (26) bears against the downwardly extending insulated portions of the pins (8) which causes the pins (8) to move axially against the action of their respective biasing springs (14) to move the conducting portion of the pins (8) into contact, respectively, with the arms of the leaf spring (20) to close both circuit breakers. At the same time, the prongs (27) of the plug (26) are being advanced into electrical contact with the contact sockets (11). It is thus noted that in the version of the invention shown in FIG. 3 and FIG. 5, the part of each pin (8) which moves against the conductive leaf spring (20) is of conductive material, while the part of each pin (8) which extends outwardly into the plug box is formed of non-conductive material or rendered non-conductive by a proper coating of non-conductive material. So long as only one of the pins (8) is pushed in, the current supply remains interrupted, and there is no voltage across the plug sockets.

A second preferred embodiment of the present invention is shown in FIG. 4 and FIG. 7. In this embodiment, the pin (8) of each circuit breaker carries a bridging element (21) which engages the ends (19 and 22) of leaf springs (20 and 23), respectively. This enables the use of actuating pins of non-conducting material on both sides of the collar (16), and also eliminates the need for having the biasing springs to be a part of the current supply circuit. Details of the esential part of this second embodiment are fully illustrated in FIG. 7. As shown there, a conducting plate (21) is attached at one end of each of the pins (8), respectively, these pins being in this case completely non-conductive. The two conducting plates bridge the gaps, respectively, between the ends (19) of the C-shaped leaf spring (20) and the ends (22) of two additional leaf springs (23), respectively. All of the leaf springs are conductive elements.

Referring to FIG. 5, the electric circuit, when the circuit breakers are closed, comes from the positive terminal of the current source through the right-hand leaf spring conductor (23), the right-hand bridge (21), the right-hand end (19) of the C-shaped leaf spring (20), the end portion (19), the bridge (21), the leaf spring (23), to the left-hand contact socket (11), the plug (26) to one terminal of the consumer appliance (25). The other terminal of the consumer appliance is directly connected to the right-hand contact socket (11).

While in the described embodiments, the safety plug socket is shown as being connected to a direct current power supply, it will readily be understood that it will operate equally well when connected to an alternating power supply.

What is claimed is:

1. An open face plug socket comprising a main body portion, a pair of parallel extending recesses in said main body portion extending inwardly from said open face, a pair of tubular conducting sockets in said recesses positioned to receive the conducting prongs of the connecting plug of a consumer appliance, a pair of circuit breakers in said body normally biased to their respective open circuit position by a pair of springs, a pair of actuating pins for closing said circuit breakers mounted for axial movement in said body to close said circuit breakers when said plug has its prongs inserted into said tubular sockets, each of said pins having a portion thereof extending out into said plug socket, circuit means directly connecting one of said conducting tubular sockets to one terminal of a power supply source, the other of said tubular sockets being connectable through one of said circuit breakers, then through the other of said circuit breakers to the other terminal of said power supply source when said circuit breakers are both closed, said circuit breakers being closed by the actuation of said actuating pins when said pins are moved by the insertion of the plug of the line cord of a consumer appliance.

2. An open face plug socket as set forth in claim 1, in which at least the inner portion of each of said actuating pins is conductive and in which each of said springs is conductive, said springs making a sliding conducting contact with its associated actuating pin, which pins each have at least a conducting surface, whereby the circuit from one of said tubular sockets is through a first one of said springs then through its associated actuating pin, through said first circuit breaker, then through the second circuit breaker, the associated actuating pin of said second circuit breaker, and said spring of said second actuation pin.

3. An open face plug socket as set forth in claim 2, in which at least the portion of each of said actuating pins which extends out into said plug box is non-conducting.

4. An open face plug socket as set forth in claim 1, in which each circuit breaker is formed by a pair of confronting free end portions of a pair of leaf springs, and in which each actuating pin carries a bridging member which closes the electric circuit of each circuit breaker when said actuating pins are moved inwardly to close the gap between the confronting ends of each pair of leaf springs, respectively.

5. A safety plug socket for two-pole power outlet plugs comprising a plug box, two circuit breakers in said box which are arranged to be serially connected in one side of a power supply circuit, spring means normally biasing said circuit breakers to their respective normally open positions, two actuating members which are independent of one another projecting into said plug box, said two circuit breakers being connected in series between one terminal of the power supply circuit and one of said contact sockets, and which in each case are in operative connection with one of said actuating members.

* * * * *